United States Patent [19]

Liebenstein

[11] Patent Number: 4,718,652

[45] Date of Patent: Jan. 12, 1988

[54] SAWBUCK

[76] Inventor: Lowell G. Liebenstein, 2142 Maple Rd., Grafton, Wis. 53024

[21] Appl. No.: 869,097

[22] Filed: May 30, 1986

[51] Int. Cl.[4] ..... B25H 1/06

[52] U.S. Cl. ..... 269/296; 269/902

[58] Field of Search ..... 269/296, 295, 289 R, 269/287, 902; 182/181, 182; 248/219.2; 144/4

[56] References Cited

U.S. PATENT DOCUMENTS

| | | | |
|---|---|---|---|
| 654,134 | 12/1900 | Clark . | |
| 691,633 | 6/1902 | Jincks et al. . | |
| 2,709,384 | 5/1955 | Harris . | |
| 4,121,814 | 10/1978 | Prior | 269/296 X |
| 4,241,772 | 12/1980 | Scherer | 182/181 X |
| 4,258,907 | 3/1981 | Roberts et al. . | |
| 4,326,703 | 4/1982 | Marley | 269/287 X |
| 4,362,295 | 12/1982 | Ford . | |
| 4,641,822 | 2/1987 | Fenerty | 269/296 |

*Primary Examiner*—Robert P. Olszewski
*Assistant Examiner*—Judy J. Hartman
*Attorney, Agent, or Firm*—Andrus, Sceales, Starke & Sawall

[57] ABSTRACT

The sawbuck includes a suitable frame for mounting a pair of opposed jaws for supporting logs or the like in cantilevered fashion at a convenient height above ground level. The upper jaw is pivotally movable to not only render it self-adjusting whereby to accommodate logs of different diameter, but also is self-locking to secure a log relative to the sawbuck.

5 Claims, 5 Drawing Figures

SAWBUCK

BACKGROUND OF THE INVENTION

This invention relates to a sawhorse or sawbuck.

With more conventional sawbucks it is generally necessary to manually move the log being cut after each severance. The generally constant manual manipulation of the logs not only requires the expenditure of much effort, but also consumes considerable time and thus tends to discourage use of such sawbucks. More often perhaps when sawing logs, they are simply cut where they were dropped or unloaded or sometimes propped one against another. Such cutting often entails awkward and tiresome bending. And when the sawing is done by a chain saw, ground and even stones are often encountered by the saw chain to rather quickly dull the saw and even render the cutting chain short-lived.

It is generally an object of this invention to provide an improved sawbuck wherein a log is quickly disposed and locked for cantilevered support at a convenient height above ground level. So disposed, the log can be cut in its entirety without further manual manipulation and without undue awkwardness and bending strain on the sawyer, and with the expectation that the saw will remain more sharp over a longer period.

SUMMARY OF THE INVENTION

The improved sawbuck of this invention contemplates a frame assembly. Opposed jaw means are mounted in common alignment on the frame assembly for receiving a log or the like therebetween for support in cantilevered fashion relative to the frame assembly and at a convenient height for sawing.

DESCRIPTION OF THE DRAWING FIGURES

The drawings furnished herewith illustrate the best mode presently contemplated for the invention and are described hereinafter.

DESCRIPTION OF THE ILLUSTRATED EMBODIMENT

Figure 1:
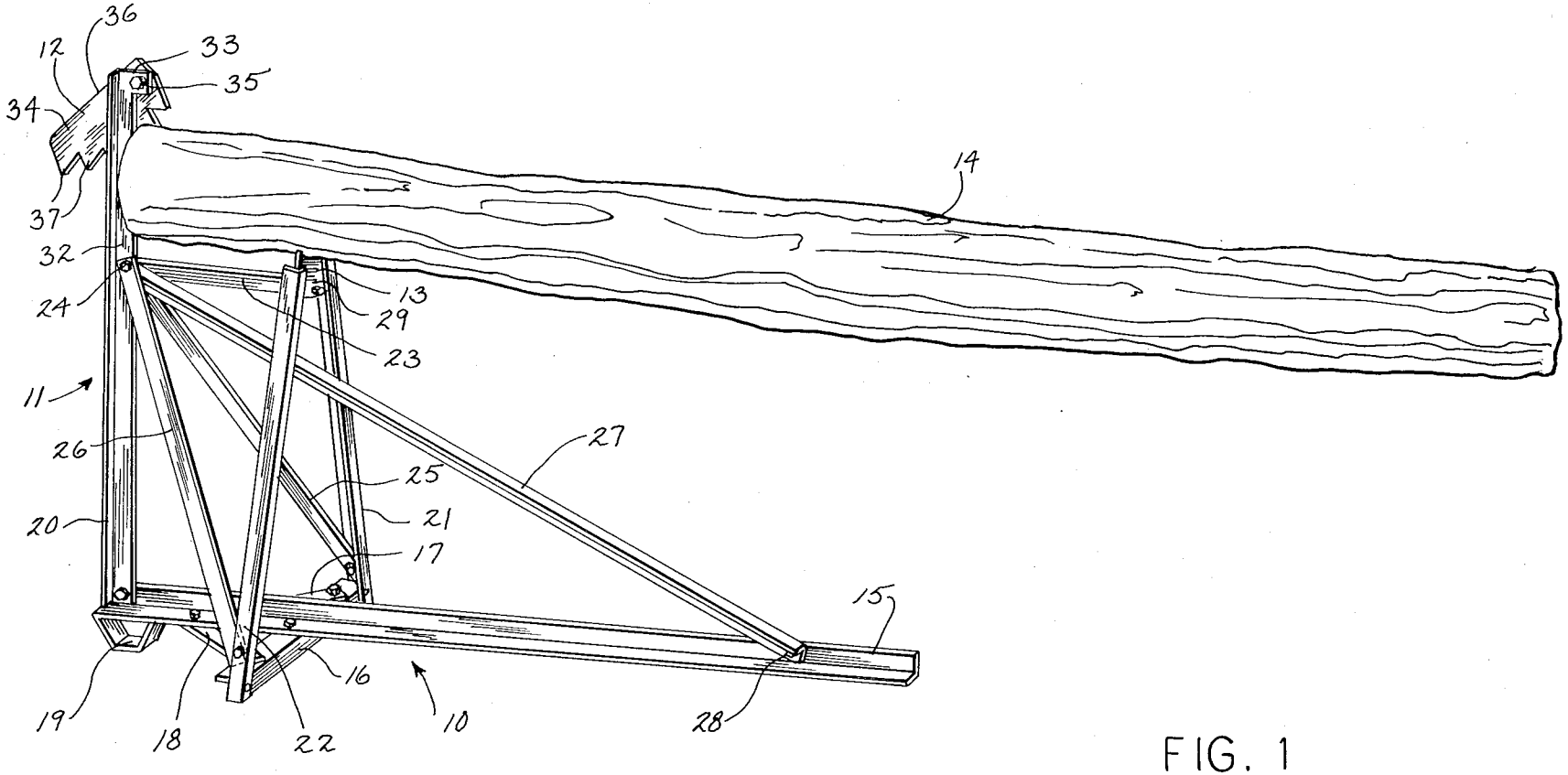
FIG. 1 is a perspective view of the sawbuck of this invention and shows a log, pole or the like being supported thereby.

Referring to the drawings, the sawbuck 10 in accordance with this invention generally includes a truss-like frame assembly 11 mounting a pair of opposed jaws 12 and 13 for supporting a log 14 or the like therebetween in cantilevered fashion.

The frame 11 of the sawbuck 10 includes a relatively long fore-and-aft extending member 15 and cross-member 16 that together form the base support. The member 15 extends over the cross-member 16 and generally centrally with respect to the frame 11 and the cross member. The cross-member 16 is disposed adjacent to but in spaced relation from the rearward end of the fore-and-aft extending member 15 such that member 15 extends forwardly beyond the cross-member to a considerable distance. The generally normal relationship between the base support members 15 and 16 is maintained by the strap members 17 and 18 that extend from the respective side portions of the cross-member 16 to a common connection with the fore-and-aft extending member 15. The bottom of the cross-member 16 together with the bottom of the forward end of the member 15 and the bottom of the depending foot 19 provided adjacent to the rear end of member 15 form a generally horizontal plane providing for the generally upright working support of the frame 11 as perhaps best shown in FIG. 2.

The upper jaw 12 of the sawbuck 10 is mounted on the frame column 20 that extends generally upright adjacent to the rear end of the base support member 15. The lower jaw 13 is provided mounting support by a pair of transversely spaced frame struts 21 and 22 that extend upwardly and inwardly from the respective ends of the cross member 16. The vertical plane generally defined by frame structs 21 and 22 with intervening jaw 13 generally parallels the frame column 20 and that relationship is maintained by the generally horizontally disposed connecting frame member 23 extending from the column 20 at 24 to the jaw 13. The frame column 20 is further strengthened by the strap members 25 and 26 which extend upwardly and rearwardly generally from the respective ends of the cross-member 16 for common connection to the frame column at 24. The frame column 20 as well as the fore-and-aft extending base support member 15 are also strengthened by a frame member 27 which extends from the frame column at 24 to a location at 28 generally adjacent to the froward end of member 15.

The lower jaw 13 generally comprises a plate member 29 supported in a generally transverse vertical plane by and between the opposed, transversely spaced frame struts 21 and 22. The upper edge of the plate member 29 forming the lower jaw 13 is provided with teeth or serrations 30. The serrations 30 are disposed along a concave arc to better engage and/or even penetrate the side of a log 14 resting thereon in service.

The frame column 20 is bifurcated to provide transversely spaced column members 31 and 32 at least upwardly from the joint or connection at 24. The column members 31 and 32 are each provided with a forwardly extending projection 33 at their upper extremity.

Figure 5:
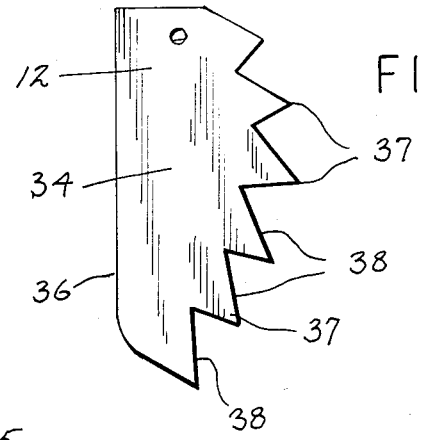
FIG. 5 is an enlarged detail view of the upper clamping jaw apart from the sawbuck.
Figure 4:
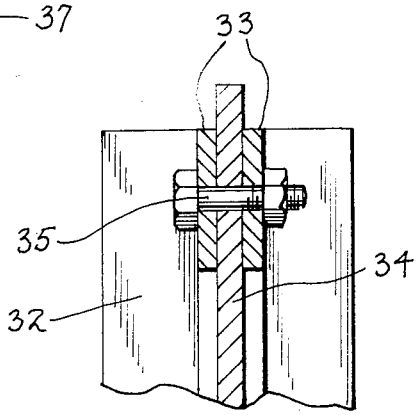
FIG. 4 is an enlarged detail view taken generally on the line 4—4 of FIG. 2.

The upper jaw 12 generally comprises a plate member 34 pivotally supported adjacent to its upper end for pivotal movement in a generally fore-and-aft extending vertical plane on the pin or bolt 35 which extends transversely through the projections 33 of the column members 31 and 32. As supported on the bolt 35, the plate member 34 has a generally straight trailing edge 36 which extends or hangs generally vertically when the sawbuck 10 is out of service. The leading edge of the plate member 34 is provided with teeth or serrations 37 which are disposed along a generally convex arc as best shown in FIG. 5. The effective serrations 37 were developed to each have a radial leading edge 38 which will extend generally vertically as that edge is brought to generally coincide with the forward edge of the column members 31 and 32 with corresponding pivotal movement of the plate member 34. With pivotal movement rearwardly of the plate member 34 forming the upper jaw 12, teeth of decreasing radii from the pin 35 are brought into play so that the upper jaw is self-adjustable to accommodate logs of widely different diameters.

Figure 2:
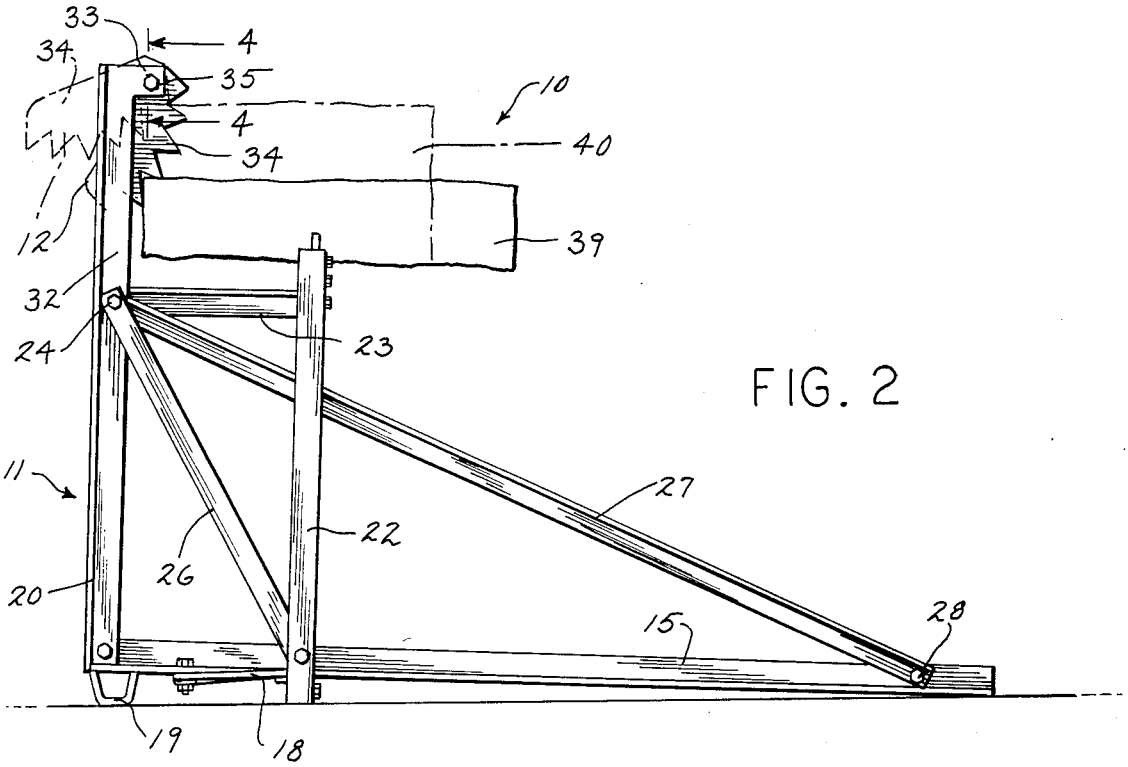
FIG. 2 is a side elevation of the sawbuck of FIG. 1 and shows log portions of different diameter supported thereby.
Figure 3:
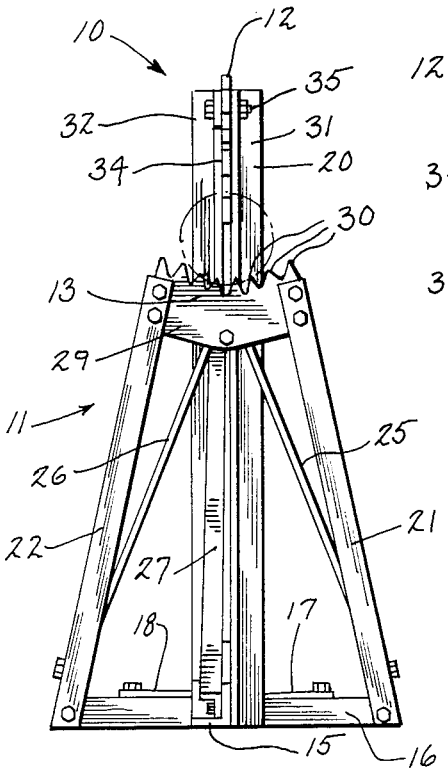
FIG. 3 is an end elevation of the sawbuck of FIG. 1.

The self-adjusting character of the upper jaw 12 is clearly demonstrated in FIGS. 1 and 2 wherein the log 14 of FIG. 1 has a diameter somewhat greater than that of the solid line log 39 of FIG. 2 and somewhat less than that of the dot-dash line log 40 of FIG. 2.

When a log is to be placed on the sawbuck 10, normally the larger end is introduced to the opposed jaws 12 and 13. The log is introduced without contact with the lower jaw 13 and maneuvered to engage with a corresponding leading edge 38 of a serration 37. When the end of the log and corresponding leading edge 38 approach or abut the frame column members 31 and 32, the log may be seated with respect to the opposed jaws 12 and 13 with the lower jaw serving as a fulcrum. In doing so, the log will pivot on the lower jaw 13 under its own weight and perhaps with additional manual assistance to provide for the under side of the log becoming penetratingly engaged upon the lower jaw. Simultaneously the upper side of the pivoting log adjacent to its end is penetratingly engaged with the next succeeding tooth 37 of the upper jaw 12 adjacent to the tooth edge 38 then abutting the end of the log. So seated, the log is supported in cantilevered fashion and at a convenient height from ground level for sawing. When supported in cantilevered position, the log is generally precluded from any movement fore-and-aft or in rotation relative to the frame assembly 11. Thus, the arrangement with the opposed jaws 12 and 13 is not only self-adjusting, but also self-locking.

When the respective frame elements 15, 16, 21, 22, 23 and 27 all comprise up to 1½ inches steel angle iron members and the frame column 20 comprises a pair of transversely spaced one (1) inch steel angle iron members, the sawbuck 10 as generally depicted in the drawings can weigh approximately forty (40) pounds. The sawbuck 10 is therefore readily portable. And if the sawbuck 10 is of bolted construction as generally depicted in the drawings, it can readily be disassembled for even greater portability and for storage, and is readily reassembled. With steel angle iron frame elements as described, the sawbuck 10 is capable of supporting logs up to eight (8) inches in diameter and up to nine (9) feet long and weighing up to one hundred and fifty (150) pounds.

With the improved sawbuck of this invention, a log is quickly disposed thereon and locked for cantilevered support at a convenient height for the sawyer. So disposed, a log can usually be cut in its entirety without additional manual manipulation and without undue awkardness and tiresome bending on the part of the sawyer.

Various modes of carrying out the invention are contemplated as being within the scope of the following claims particularly pointing out and distinctly claiming the subject matter which is regarded as the invention.

I claim:

1. A sawbuck for the support of logs or the like, comprising a frame assembly, and opposed jaw means mounted on the frame assembly for receiving a log or the like therebetween, said jaw means comprising a lower jaw and an upper jaw, said lower jaw being spaced beneath and ahead of said upper jaw and serving as a fulcrum support upon which a log or the like can rest and pivot into engagement with the upper jaw for cantilevered support relative to the frame assembly, said upper jaw comprising a plate member pivotally disposed for movement in a generally fore-and-aft vertical plane for engaging with a log or the like adjacent to the rear end thereof.

2. The structure as set forth in claim 1 wherein the lower jaw comprises a fixed plate member disposed in a generally vertical plane generally normal to the plane of the upper jaw.

3. The structure as set forth in claim 2 wherein the upper edge of the lower jaw plate member which is engageable with the underside of a log or the like is concavely arcuate and provided with serrations.

4. The structure as set forth in claim 1 wherein the pivotal upper jaw has a serrated leading edge and is not only pivotally self-adjusting to accommodate logs or the like of different diameters but is also self-locking to secure a log relative to the frame assembly.

5. The structure as set forth in claim 4 wherein the effective serrations on the leading edge of the upper jaw plate member are disposed in a convexly arcuate arrangement.

* * * * *